US011051674B2

(12) United States Patent
Gonzalez et al.

(10) Patent No.: US 11,051,674 B2
(45) **Date of Patent: *Jul. 6, 2021**

(54) GLASS RINSER SPIN STOP

(71) Applicant: Micro Matic USA, Inc., Brooksville, FL (US)

(72) Inventors: Edgar Gonzalez, Davenport, FL (US); Tom Geordt, Belvidere, IL (US)

(73) Assignee: Micro Matic USA, Inc., Brooksville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/705,761

(22) Filed: Dec. 6, 2019

(65) Prior Publication Data

US 2020/0107695 A1 Apr. 9, 2020

Related U.S. Application Data

(63) Continuation of application No. 15/382,094, filed on Dec. 16, 2016, now Pat. No. 10,575,705.

(60) Provisional application No. 62/269,369, filed on Dec. 18, 2015.

(51) Int. Cl.
*A47L 15/00* (2006.01)

(52) U.S. Cl.
CPC ..... *A47L 15/0065* (2013.01)

(58) Field of Classification Search
None
See application file for complete search history.

(56) References Cited

U.S. PATENT DOCUMENTS

| | | | | |
|---|---|---|---|---|
| 2,294,668 A * | 9/1942 | Karas | A47L 15/0065 134/55 |
| 4,427,221 A * | 1/1984 | Shay, Jr. | E21B 10/18 175/340 |
| 2005/0145717 A1* | 7/2005 | Katz | B05B 15/62 239/279 |
| 2012/0204342 A1* | 8/2012 | Hotaling | A23G 9/30 4/625 |

* cited by examiner

*Primary Examiner* — Cristi J Tate-Sims
(74) *Attorney, Agent, or Firm* — Burr & Forman LLP; Ryan M. Corbett

(57) ABSTRACT

A glass rinser apparatus is provided. The glass rinser apparatus may include a spray nozzle configured to output a liquid, a shank configured to be coupled at a first end to the spray nozzle, and to transmit the liquid to the spray nozzle, and a nut configured to be coupled to the second end of the shank. The shank may be shaped so that the shank does not rotate when the nut is coupled to the second end of the shank. The cross section of the shank may be substantially circular, and may include at least one flat portion.

18 Claims, 3 Drawing Sheets

GLASS RINSER SPIN STOP

CROSS-REFERENCE TO RELATED APPLICATION

This application is a continuation of U.S. patent application Ser. No. 15/382,094, filed Dec. 16, 2016, which claims the benefit of U.S. Provisional Patent Application No. 62/269,369, filed on Dec. 18, 2015, both of which are incorporated herein by reference in their entirety.

TECHNICAL FIELD

The present disclosure relates generally to an apparatus for connecting a glass rinser and a drip tray for use in beverage dispensing.

SUMMARY

In the beverage dispensing industry, it is known to use perforated drip trays so that excess amounts of the dispensed beverage can be collected so that the excess beverage does not spill onto the bar or the floor. For example, referring to FIG. 1, the drip tray 100 may include a grid 110 having a plurality of holes, and a solid tray 120 beneath the grid that collects the excess beverage after it passes through the holes of the grid. The grid may include one or more notches 130 that allow the grid to be removed so that the tray can be emptied.

The drip tray may also include a glass rinser that allows the user to rinse a glass before pouring the beverage into the glass. Referring to FIG. 1, the glass rinser 140 may include a round grid 150 having a plurality of holes and a spray nozzle 160 located in the center of the grid 150. When installed, the glass rinser grid 150 and the drip tray grid 110 may be disposed in a parallel relationship, so that the two grids form a substantially flat surface. The spray nozzle 160 may be connected to a water source and a mechanical actuator that causes the spray nozzle 160 to spray water when the grid 150 is depressed in the downward direction. In practice, the user holds a glass upside down over the spray nozzle 160 and presses the glass downward so as to depress the grid 150. The downward depression of the grid 150 causes the spray nozzle 160 to spray water generally in the upward direction so that the glass may be rinsed clean of foreign particles.

Despite their functionality, glass rinsers can be difficult to install. Most glass rinsers include a hollow shank that extends vertically downward from the spray nozzle, and through which the water passes when the grid 150 is depressed. The hollow shank is typically threaded so as to engage with a nut that is screwed onto the shank to secure the shank to the tray. However, when screwing the nut onto the shank, the shank must be prevented from rotating. Otherwise, the nut and shank will rotate together, such that the nut will not tighten on the shank. To prevent the shank from rotating, an installer must use a tool such as a vice grips or channel lock pliers to hold the shank stationary while the installer tightens the nut with the installer's other hand. Often the shank is located in a tight space such that using two hands and/or additional tools may be difficult, which may lead to inadequate mounting or sealing. Moreover, using tools to tighten the nut may damage the shank. Accordingly, there is a need for an apparatus that allows for more convenient installation and that reduces the possibility of damaging the shank.

According to an aspect of one or more exemplary embodiments, there is provided a glass rinser apparatus that may include a spray nozzle configured to output a liquid, a shank configured to be coupled at a first end to the spray nozzle, and to transmit the liquid to the spray nozzle, and a nut configured to be coupled to the second end of the shank. The shank may be shaped so that the shank does not rotate when the nut is coupled to the second end of the shank. The cross section of the shank may be substantially circular, and may include at least one flat portion. Alternatively, the cross section of the shank may be substantially square, rectangular, triangular, or star-shaped. The flat portion of the shank may extend along substantially the entire axial length of the shank. Alternatively, the flat portion may only be disposed at the second end of the shank.

The glass rinser apparatus according to one or more exemplary embodiments may also include a drip tray having a hole configured to receive the second end of the shank. The hole may be substantially circular, and may include a flat portion. The hole in the drip tray may be configured to engage the shank and prevent the shank from rotating when the nut is coupled to the second end of the shank. If the cross section of the shank is substantially square, rectangular, triangular, or star-shaped, the hole in the drip tray may have substantially the same shape as the cross section of the shank.

The glass rinser apparatus according to one or more exemplary embodiments may also include a rinser grid configured to be coupled to the spray nozzle and the shank, wherein when the rinser grid is depressed, the liquid is caused to pass through the shank and be output by the spray nozzle. The glass rinser apparatus may also include a grid configured to be disposed within the drip tray, wherein the grid may include a hole configured to receive the shank.

DETAILED DESCRIPTION OF EXEMPLARY EMBODIMENTS

Figure 1:
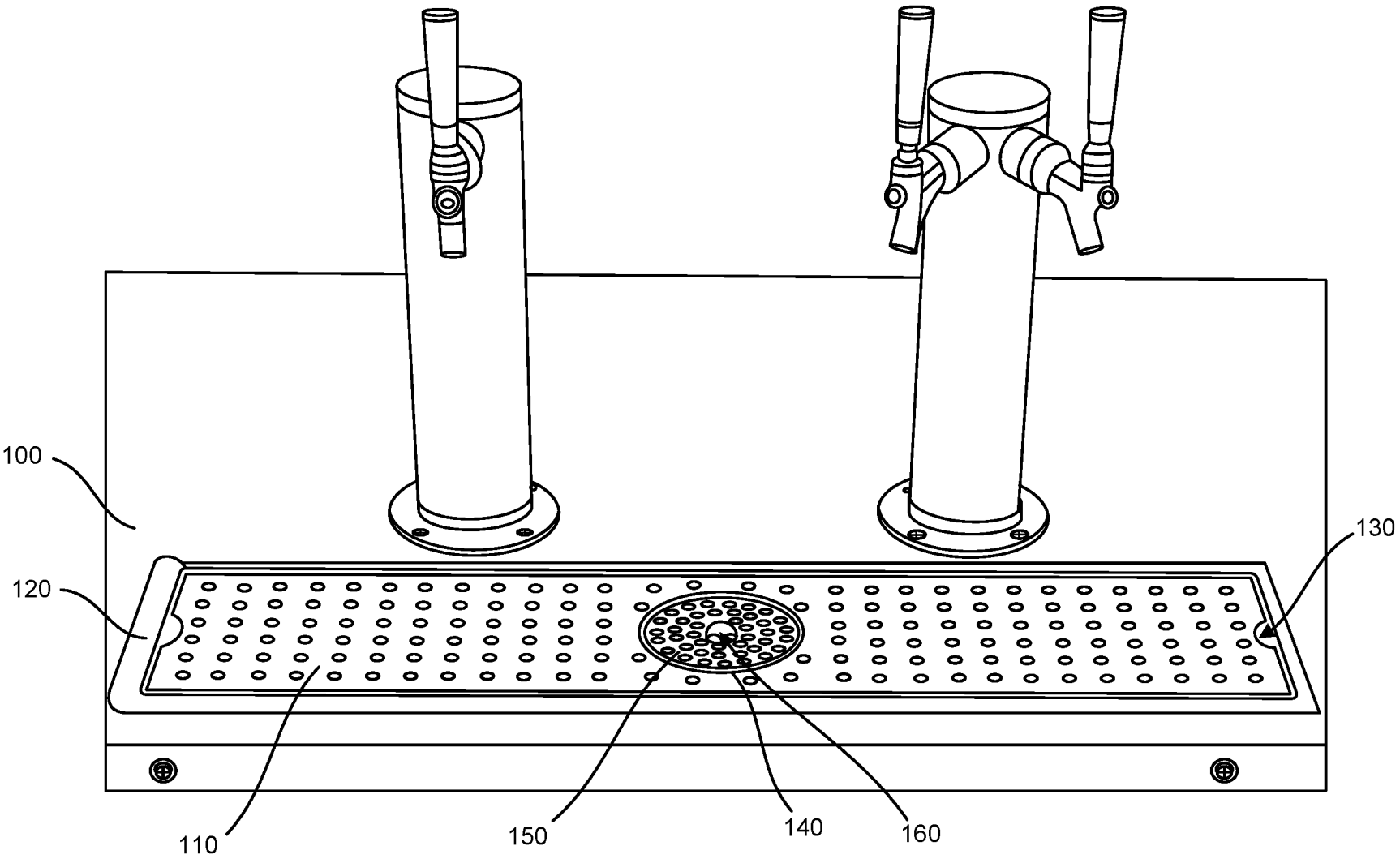
FIG. 1 illustrates a drip tray and glass rinser according to the related art.

Reference will now be made in detail to the following exemplary embodiments, which are illustrated in the accompanying drawings, wherein like reference numerals refer to like elements throughout. The exemplary embodiments may be embodied in various forms without being limited to the exemplary embodiments set forth herein. Descriptions of well-known parts are omitted for clarity.

Figure 2:
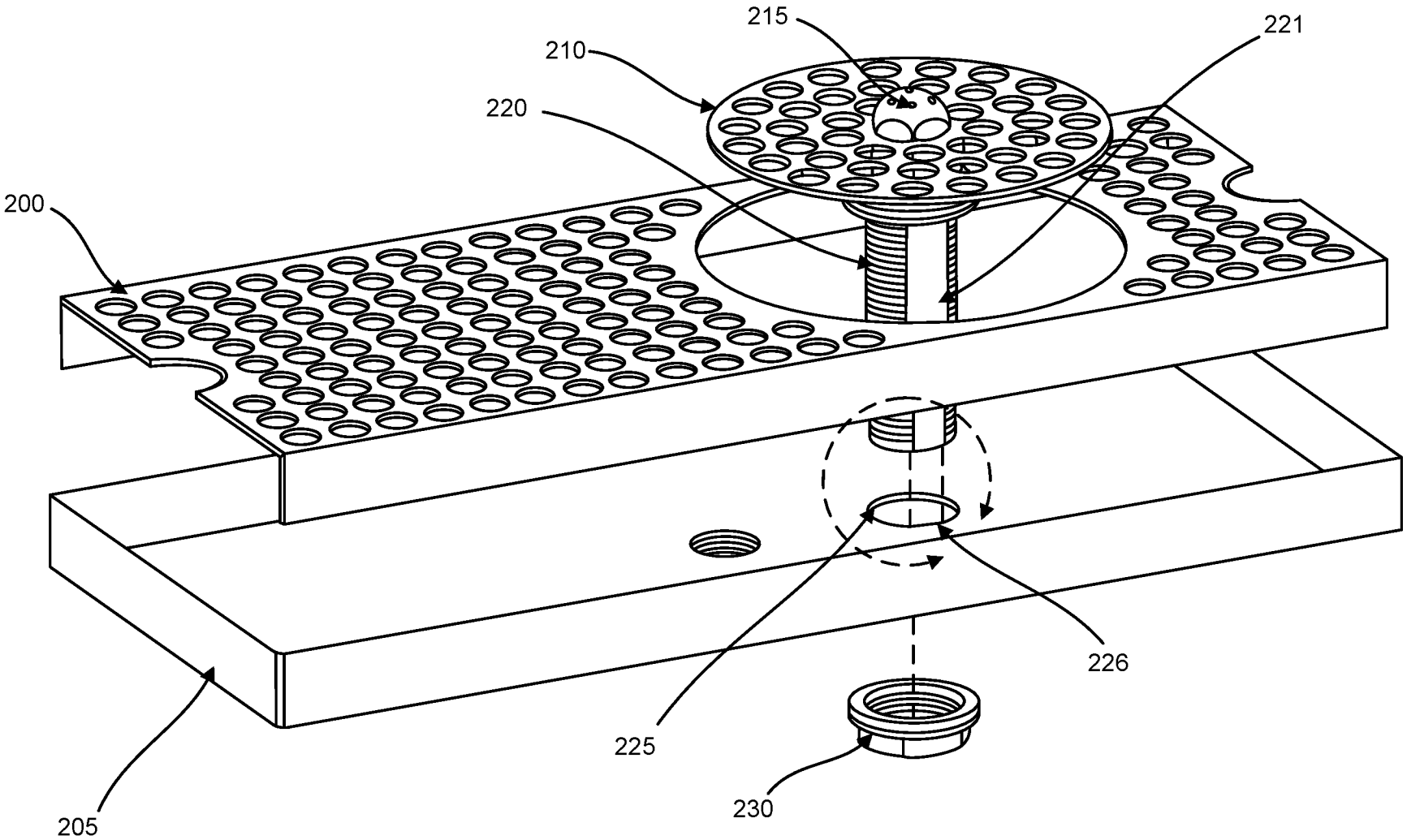
FIG. 2 illustrates an exploded view of a glass rinser device according to an exemplary embodiment.

FIG. 2 is an exploded view of a glass rinser device according to an exemplary embodiment. According to the exemplary embodiment shown in FIG. 2, there is provided a glass rinser device that may include a grid 200 that is configured to be disposed in drip tray 205 so that liquid may pass through the plurality of holes in grid 200 and collect in drip tray 205. The glass rinser device may also include a rinser grid 210, spray nozzle 215, and shank 220. The rinser grid 210 shown in FIG. 2 is circular, however the rinser grid 210 may have a different shape. Spray nozzle 215 may include one or more openings through which water is sprayed in order to rinse a glass (not shown) when a user positions the glass above the rinser grid 210. Rinser grid 210 may include a plurality of holes through which the water sprayed by spray nozzle 215 may drain down into the drip tray 205. The shank 220 may be elongated in a vertical direction, and may include threads on the outer circumference of the shank 220. The shank 220 may also be hollow so that water may flow upward through the shank 220 to be sprayed from spray nozzle 215. Water may be caused to flow up the shank 220 and out through spray nozzle 215 by depressing the rinser grid 210, although other ways of generating water flow through the shank 220 and spray nozzle 215 may be used.

The shank 220 may be generally cylindrical in shape, but may also include a flat portion 221. As shown in FIG. 2, the flat portion 221 may extend in an axial direction of the shank 220. Drip tray 205 may also include a hole 225 that is configured to receive shank 220. The hole 225 may be generally circular, but may also have a flat portion 226 that is configured to coincide with the flat portion 221 of shank 220. Although the exemplary embodiment of FIG. 2 shows the flat portion 221 extending along the entire axial length of the shank 220, the flat portion 221 may alternatively only be located at the portion of the shank 220 that engages the hole 225 in the drip tray 205. The glass rinser device of the exemplary embodiment may also include a nut 230 that may be threaded along its inner circumference and is configured to attach to the end of shank 220.

When assembling the glass rinser device, the shank 220 may be disposed through the hole 225 so that the flat portion 221 of the shank 220 aligns with the flat portion 226 of the hole 225. Nut 230 is then placed on the end of shank 220 and rotated until tight. The flat portion 221 of the shank 220 and the flat portion 226 of the hole 225 engage to prevent the shank 220 from rotating while the nut 230 is rotated. In this way, the inner threads of the nut 230 engage the outer threads of shank 220 so that the nut may be tightened on the shank. Because the flat portions 225 and 226 prevent the shank 220 from rotating during installation, the nut 230 can be attached to the shank 220 without the need for holding the shank 220 (by hand, or with a tool), such that the nut 230 can be applied with one hand. Although the shank 220 and the hole 225 in the exemplary embodiment of FIG. 2 are substantially round, the shank and the hole may be a different shape that prevents the shank from rotating while the nut is applied. For example, the shank and hole may have a square, rectangle, triangle, or star shape.

Figure 3:
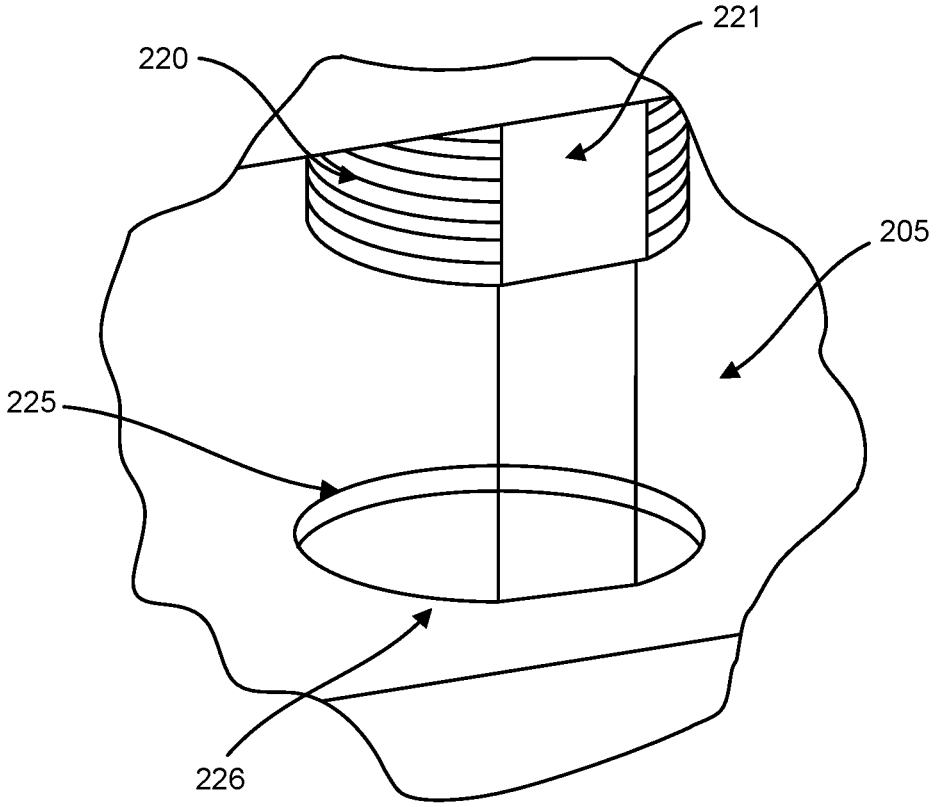
FIG. 3 illustrates an enlarged view of a portion of the glass rinser device according to an exemplary embodiment.

FIG. 3 is an enlarged view of the shank 220 and the hole 225. As shown in FIG. 3, the flat portion 221 of shank 220 is aligned with the flat portion 226 of hole 225 so that rotation of the shank 220 is prevented while the nut (not shown) is rotated on the end of the shank 220.

Although the inventive concepts of the present disclosure have been described and illustrated with respect to exemplary embodiments thereof, it is not limited to the exemplary embodiments disclosed herein and modifications may be made therein without departing from the scope of the inventive concepts.

What is claimed is:

1. A glass rinser apparatus comprising:

a spray nozzle configured to output a liquid;

a shank having a first end configured to be coupled to the spray nozzle to transmit the liquid to the spray nozzle;

wherein the shank includes a stop portion that is configured to prevent the shank from rotating by engaging a drip tray when a nut is coupled to a second end of the shank.

2. The glass rinser apparatus of claim 1, wherein the stop portion of the shank is configured to engage an edge portion of a hole in the drip tray to prevent the shank from rotating.

3. The glass rinser apparatus of claim 1, wherein a cross section of the shank is substantially circular, and the stop portion includes at least one flat portion.

4. The glass rinser apparatus of claim 1, wherein a cross section of the shank is substantially square, rectangular, triangular, or star-shaped.

5. The glass rinser apparatus of claim 2, wherein the hole in the drip tray is substantially circular, and an edge of the hole includes a flat portion.

6. The glass rinser apparatus of claim 5, wherein the stop portion of the shank engages the flat portion of the edge of the hole.

7. A glass rinser apparatus comprising:

a spray nozzle configured to output a liquid;

a shank having a first end configured to be coupled to the spray nozzle to transmit the liquid to the spray nozzle; and a nut configured to be coupled to a second end of the shank;

wherein the shank includes a stop portion that is configured to prevent the shank from rotating by engaging a drip tray when the nut is coupled to the second end of the shank.

8. The glass rinser apparatus of claim 7, wherein the stop portion of the shank is configured to engage an edge portion of a hole in the drip tray to prevent the shank from rotating.

9. The glass rinser apparatus of claim 7, wherein a cross section of the shank is substantially circular, and the stop portion includes at least one flat portion.

10. The glass rinser apparatus of claim 7, wherein a cross section of the shank is substantially square, rectangular, triangular, or star-shaped.

11. The glass rinser apparatus of claim 8, wherein the hole in the drip tray is substantially circular, and an edge of the hole includes a flat portion.

12. The glass rinser apparatus of claim 11, wherein the stop portion of the shank engages the flat portion of the edge of the hole.

13. A method of assembling a glass rinser apparatus, the method comprising:

inserting a shank through a hole in a drip tray, said shank including a first end coupled to a spray nozzle; and coupling a nut to a second end of the shank;

wherein the shank includes a stop portion that is configured to prevent the shank from rotating while the nut is coupled to the second end of the shank by engaging the drip tray.

14. The method of claim 13, wherein during coupling of the nut to the second end of the shank, the stop portion of the shank engages an edge portion of the hole in the drip tray.

15. The method of claim 13, wherein a cross section of the shank is substantially circular, and the stop portion includes at least one flat portion.

16. The method of claim 13, wherein a cross section of the shank is substantially square, rectangular, triangular, or star-shaped.

17. The method of claim 14, wherein the hole in the drip tray is substantially circular, and the edge of the hole includes a flat portion.

18. The method of claim 17, wherein the stop portion of the shank engages the flat portion of the edge of the hole.

* * * * *